US005098209A

United States Patent [19]

Gomoll et al.

[11] Patent Number: 5,098,209

[45] Date of Patent: Mar. 24, 1992

[54] DRIVING A PRINTHEAD CARRIAGE IN A PRINTER

[75] Inventors: Guenter Gomoll, Nersingen/Leibi; Wolfgang Hauslaib, Langenau, both of Fed. Rep. of Germany

[73] Assignee: Mannesmann AG, Fed. Rep. of Germany

[21] Appl. No.: 376,951

[22] Filed: Jul. 7, 1989

Related U.S. Application Data

[63] Continuation of Ser. No. 259,436, Oct. 14, 1988, abandoned, which is a continuation of Ser. No. 22,979, Mar. 6, 1987, abandoned.

[30] Foreign Application Priority Data

Mar. 11, 1986 [DE] Fed. Rep. of Germany ..... 3608000

[51] Int. Cl.[5] ..... B41J 19/14

[52] U.S. Cl. ..... 400/320; 400/335

[58] Field of Search ..... 400/320, 322, 335; 74/89.22; 474/113, 117

[56] References Cited

U.S. PATENT DOCUMENTS

| | | | |
|---|---|---|---|
| 3,861,657 | 1/1975 | Sims | 474/117 X |
| 3,951,249 | 4/1976 | Nerbas | 400/335 X |
| 3,973,662 | 8/1976 | Fulton | 400/322 X |
| 4,395,151 | 7/1983 | Krenz | 400/320 |
| 4,504,158 | 3/1985 | Ciampi | 400/320 X |

FOREIGN PATENT DOCUMENTS

| | | | |
|---|---|---|---|
| 29690 | 2/1983 | Japan | 400/322 |

OTHER PUBLICATIONS

*IBM Tech. Disc. Bulletin*, by K. Yosmali, vol. 19, No. 12, May 1977, pp. 4654–4658.

*Primary Examiner*—Edgar S. Burr
*Assistant Examiner*—Ren Yan
*Attorney, Agent, or Firm*—R. H. Siegemund

[57] ABSTRACT

The drive includes a cable attached to opposite sides of the print head carrying carriage, looping on one side in several loops around a drive drum, and on the other side around a deflection pulley. The deflection pulley is mounted on a spring-biased pivot lever to tension the cable in an adjustable manner. The drum is connected to the drive motor in a compact fashion by means of a belt drive.

5 Claims, 1 Drawing Sheet

1
2
3
4
5
6
6a
7
8
9
10
11
12
13
14
15
16
17
18
19
20
21
22
23
24
25
26
27
28
29
30

DRIVING A PRINTHEAD CARRIAGE IN A PRINTER

This is a continuation of copending application Ser. No. 259,436 filed on Oct. 14, 1988, now abandoned, which was a continuation of application Ser. No. 022,979 filed on Mar. 6, 1987, now abandoned.

BACKGROUND OF THE INVENTION

The present invention relates to driving a carriage, the carriage carrying a print head in a printer, particularly a matrix printer, under utilization of a drive motor, and of a cable to which the carriage is attached and which is run through a driven drum pulley or sheave being journalled in stationary fashion. The cable being looped has several loops around the drum and is run around a deflection pulley disposed on the opposite side of the printer frame and returned, so to speak, to the other side of the carriage.

Drives of the type to which the invention pertains are usually controlled through a clocking or timing circuit, wherein a control is provided using increments of the travel path as controlling units. These increments are, for example, represented by a slotted disk, and a scanner produces rectangular signals as the slotted disk rotates commensurate with the carriage propagation. These signals for pulses progressively indicate the propagation of the head past the printing platen. The pulses are then used, for example, to control a step motor or DC motor.

Printers, particularly matrix printers, which are manufactured in large numbers, often use differently heavy print heads to be combined with the drive mechanism. For economic reasons and mass production the same kind of drive mechanism should be used for different heads. Therefore, the drive has to be configured so that at least small differences in the weight among the various heads can easily be compensated for.

DESCRIPTION OF THE INVENTION

It is an object of the present invention to provide a new and improved motor driven cable drive for print head carriages, wherein, for example, the tension of the cable can be adjusted or re-adjusted, while, on the other hand, different tension is possible for accommodating different weights or masses of different print heads.

It is, therefore, a specific object of the present invention to provide a new and improved cable drive for print heads, particularly matrix print heads, which is of a universal nature and permits the driving of different print heads having different weights.

In accordance with the preferred embodiment of the present invention, it is suggested to provide a cable deflection or reversing pulley which is not directly journalled on the printer frame but on a lever, which lever is articulated, pivoted or hinged to the frame, while a free arm is connected to the same frame but through a spring. The spring, in fact, is a determining factor for the tension in the cable to which the carriage is fastened in the aforementioned manner. On the other hand, adjusting the tension of the spring, i.e. a tuning of this tension bias provided for the cable, permits adjusting of the force the cable exerts upon the print head carriage, which adjustment takes care of different masses or different kinds of print heads.

In furtherance of the invention, it is suggested to provide the sheave or pulley mounting lever, as far as its pivot end is concerned as a projection which is inserted in an opening of the frame. This feature facilitates the providing of a pivot mount which, on one hand, positions the sheave or pulley mounting lever with a sufficient degree of accuracy, but articulates that lever to the extent such articulation, pivotability, or hingeability is necessary. The lever biasing spring is fastened, on one hand, to the printer frame, while, on the other hand, a adjusting screw is used which traverses the spring, consigned as a coil spring, and is attached to the printer frame.

In addition, certain features are suggested which control, to some extent, the transmission of the forces, i.e. the tension forces, upon the cable. Here then, it is suggested to have the drum looped by the cable in several loops, and journaled on a stationary shaft for being driven by the drive motor, and to have this shaft together with the journaled drum mounted on an angle piece. That angle piece carries also the motor and its drive shaft is connected to the drum by a belt. This feature is instrumental in providing for a compact drive and, therefore, saves space, which is an important feature in matrix printers; but also noise and sound attenuation is provided owing to the various resiliency inherent in these elements as they attenuate vibrations of a parasitic nature. The shaft of the motor should be drivingly connected to the multiple loop sheaf or roller by means of a toothed belt which also has the effect of attenuating vibrations.

DESCRIPTION OF THE DRAWINGS

While the specification concludes with claims particularly pointing out and disinctly claiming the subject matter which is regarded as the invention, it is believed that the invention, the objects and features of the invention, and further objects, features and advantages thereof will be better understood from the following description taken in connection with the accompanying drawings in which:

Figures 1, 2:
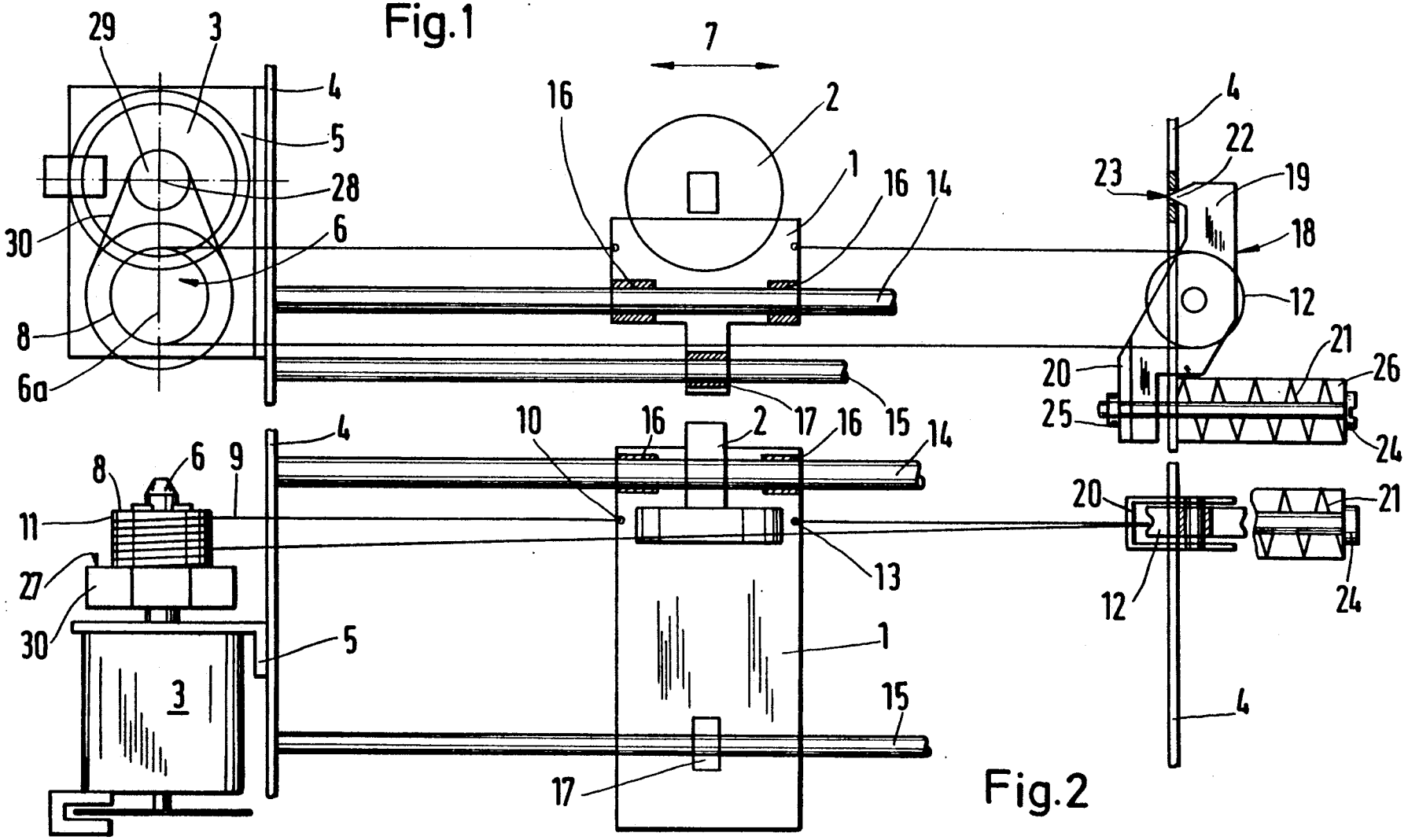
FIG. 1 illustrates a front view of the drive mechanism for the print head in a matrix printer and constructed in accordance with the preferred embodiment of the present invention for practicing the best mode thereof.
FIG. 2 is a top elevation of the device shown in FIG. 1.

Proceeding now to the detailed description of the drawings, the illustrated example assumes a matrix printer wherein many parts, which are conventional in printers, have been omitted. Shown is the carriage 1 for a print head 2 being, for example, a matrix print head. That carriage runs on a rail constructed as a round bar 14 which extends between opposite walls 4 of the printer frame. In addition, there is a balancing shaft or bar 15 engaging the carriage at a location somewhat off the print head 2. Reference numeral 16 refers to glide sleeves by means of which the carriage 1 rides on and slides along the bar 14, sleeve 17 holds the carriage 1 slidably in engagement with shaft or bar 15.

The driving arrangement includes a drive motor 3 which is either an electric DC motor or a step motor. The print head 2 is easily exchangeable, that is to say, different print heads, possibly even different kinds of print heads in terms of weight and construction, can be mounted on a universal-like carriage 1. By means of an angle piece 5 the motor 3 is secured to one of the side walls 4 of the printer which angle piece 5, moreover, supports a stationary shaft or pin 6 having a center axis 6a which extends transversely to the direction 7 of the print head carriage 1. Shaft 6, on the other hand, serves as stationary mounting pin for journalling a cable roller, sheaf, pulley, or drum 8. The drum carries a plurality of loops of the drive cable 9.

Both ends of the cable 9 are affixed to the carriage 1. One end portion of the cable 9 leads directly from the drum 8 towards a fastening point 10 on the carriage 1. The other end of the cable runs across the space defined between the two side walls 4, and loops around a deflection pulley 12, and returns towards the carriage 1 to be fastened thereto at an anchoring point 13. Depending upon the direction of rotation of the drum 8, the carriage 1 moves in one of the opposite directions across the printing platen, which is not shown and conventional, and situated in front of the head 2.

Thus far we have described basic aspects of the carriage drive, and we turn now to particulars related specifically to the mounting, positioning, and biasing of the deflection pulley 12. This deflection pulley 12 is journalled on a one-arm lever 18. One end 19 of that lever 18 is hinged or pivoted in the frame 4 in a pivotable manner, which point of engagement establishes, in effect, a fulcrum for the lever, thus being, a one-arm lever 8. Lever end 19 has particularly a projection 22 which engages and reaches into an opening 23 of the frame 4, which connection establishes the fulcrum of the lever and the pivot point thereof. Free arm 20 of lever 18 extends beyond pulley 12 which thus is mounted in between the fulcrum end 19 and the free end 20.

A spring 21 is affixed with one end to the one printer frame wall 4; the other end of the spring bears against the head 24*a* of an adjusting screw 24, whose shank traverses the spring 21 and has its other end affixed by means of a nut 25 to the end of lever arm 20. Preferably, spring 21 is encased in a housing 26. It can, thus, be seen that the screw 24 simply adjusts the bias, i.e. extension or shortening of the spring 21. This way then, the resilient bias exerted upon the free end 20 of lever 18 is adjusted which adjusts the effective force by means of which pulley 12 tensions the cable.

At the side of the drive motor 3, the drum 8 is, as stated, journalled on the shaft 6, which is mounted on the angle piece 5. The drum 8 is combined with a belt sheave or pulley 27. The shaft 28 of the motor 3 carries a similar belt sheave or pulley 29, and the two pulleys or sheaves 27 and 29 are interconnected by a toothed belt 30. This way then, drum 8 is being driven by the motor. The elements 27, 29, and 8 thus constitute a unit combined by means of the angle piece 5.

The invention is not limited to the embodiments described above, but all changes and modifications thereof not constituting departures from the spirit and scope of the invention, are intended to be included.

We claim:

1. A drive for a carriage carrying a print head in a printer, the carriage being mounted on rail means for reciprocating within a printer frame, there being a cable affixed on two points to the carriage, the cable running, on one side of the frame on to a cable drum and around it in multiple loops, and on the opposite side of the frame the cable runs around a deflection pulley, the cable being driven by cable drive means to thereby drive the head the improvement comprising:

a pivot lever for mounting and journaling the deflection pulley at a point intermediate a fulcrum and a free end of the lever;

means for acting on the free end of the two arm lever in relation to and on the printer frame, on the outside thereof, for pivoting the lever about its fulcrum, said frame having an opening, said lever constructed so that its fulcrum end enters the opening as well as the inside of the frame through th opening to thereby establish the fulcrum; and adjustable spring means on the outside of the frame and having an adjustable actuation element traversing the frame and engaging said free end of the lever, inside of the frame to thereby adjustably determine the tension in the carriage driving cable during driving of the head as the cable is being driven by cable drive means.

2. The improvement as in claim 1, wherein said spring means has one end attached and connected to the frame, the other end of the spring means bearing against an adjusting screw whose shank traverses the spring means, and has its opposite end connected to said pulley mounting lever.

3. A drive for a carriage carrying a print head in a printer, the drive including a motor, the carriage being mounted on rail means for reciprocating within the printer frame, there being a cable affixed on two points to the carriage, the cable running on one side of the frame around a cable drum in multiple loops, and on the opposite side of the frame around a deflection pulley, the improvement comprising:

a pivot lever having a fulcrum for mounting the deflection pulley, at a point intermediate said fulcrum of the lever and a free end thereof for pivoting the lever on said fulcrum in relation to the printer frame;

said frame having an opening, said lever having a projection entering the opening and establishing therewith said fulcrum for pivoting the lever; and adjustable spring means for biasing said pulley mounting lever at said free end, to thereby adjustably determining the tension in the carriage driving cable;

a journalling pin mounted to said printer frame, said drum being journalled on said pin; and the motor being drivingly connected to said drum for driving the drum.

4. The improvement as in claim 3, there being an angle piece secured to the frame, said pin and said motor being connected to said angle piece.

5. The improvement as in claim 3, wherein said spring means has one end attached and connected to the frame, the other end of the spring means bearing against an adjusting screw whose shank traverses the spring means, one end of an opposite end of the screw being connected to said pulley mounting lever.

* * * * *